US012442285B2

(12) United States Patent
O'Neill et al.

(10) Patent No.: US 12,442,285 B2
(45) Date of Patent: Oct. 14, 2025

(54) METHOD AND APPARATUS FOR IDENTIFYING ANALOG WELLS

(71) Applicant: BP Corporation North America Inc., Houston, TX (US)

(72) Inventors: Adrian O'Neill, London (GB); Casey Denny, Houston, TX (US); Jeremy Eade, Houston, TX (US); Chunlei Chu, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 491 days.

(21) Appl. No.: 17/978,434

(22) Filed: Nov. 1, 2022

(65) Prior Publication Data

US 2023/0135833 A1 May 4, 2023

Related U.S. Application Data

(60) Provisional application No. 63/275,276, filed on Nov. 3, 2021.

(51) Int. Cl.
*E21B 44/00* (2006.01)
*E21B 41/00* (2006.01)

(52) U.S. Cl.
CPC ..... *E21B 44/00* (2013.01); *E21B 41/00* (2013.01)

(58) Field of Classification Search
None
See application file for complete search history.

(56) References Cited

U.S. PATENT DOCUMENTS

| | | | | |
|---|---|---|---|---|
| 2019/0325331 | A1 | 10/2019 | Benhallam et al. | |
| 2020/0040719 | A1* | 2/2020 | Maniar | E21B 41/00 |
| 2020/0183042 | A1* | 6/2020 | Amidi | G06F 18/232 |
| 2021/0047914 | A1* | 2/2021 | Zhernakov | G01V 20/00 |
| 2021/0279376 | A1* | 9/2021 | Langenborg | G06Q 50/02 |

FOREIGN PATENT DOCUMENTS

| | | | |
|---|---|---|---|
| WO | 2018067131 | A1 | 4/2018 |
| WO | 2020167349 | A1 | 8/2020 |
| WO | 2020190942 | A1 | 9/2020 |

OTHER PUBLICATIONS

International Search Report and Written Opinion dated Feb. 16, 2023 for PCT/US2022/048538.
Azerbaijjani Office Action dated Jun. 10, 2025 for AZ Application No. a 20240073 with English summary.

* cited by examiner

*Primary Examiner* — Lina Cordero
(74) *Attorney, Agent, or Firm* — Conley Rose, P.C.

(57) ABSTRACT

A method for planning a subject well includes receiving a well profile for the subject well, the well profile comprising a plurality of sets of attributes, each corresponding to one of a plurality of depths of the subject well; categorizing each of the sets of attributes as being in a first zone or in a second zone to generate a pivoted well profile, where the pivoted well profile includes a number of the sets of attributes in the first zone and a number of the sets of attributes in the second zone; comparing the pivoted well profile of the subject well to a library of well profiles; identifying, based on the comparison, an analog well from the library, where a difference between the analog well profile and the pivoted well profile is less than a threshold; and providing an indication of the identified analog well.

18 Claims, 5 Drawing Sheets

METHOD AND APPARATUS FOR IDENTIFYING ANALOG WELLS

CROSS-REFERENCE TO RELATED APPLICATIONS

This application claims benefit of U.S. Provisional Application Ser. No. 63/275,276 filed Nov. 3, 2021, and entitled "Method and Apparatus for Implementing an Automatic Analogue Well-Finder Clustering Model," which is hereby incorporated herein by reference in its entirety.

STATEMENT REGARDING FEDERALLY SPONSORED RESEARCH OR DEVELOPMENT

Not applicable.

BACKGROUND

Embodiments disclosed herein generally relate to wellbore designs and various wellbore operations, such as drilling operation, completion operations, production operations, and the like. More particularly, embodiments disclosed herein relate to systems and methods for planning a subject well by identifying analog well(s) and, in some cases, adjusting attributes of the subject well based on the identified analog well(s) and lessons learned therefrom.

Wellbores are drilled into subterranean earthen formations to facilitate the recovery of hydrocarbons or other resources from reservoirs within the earthen formation. When planning a new well (also referred to herein as a "subject well"), data from previously-drilled wells may be consulted to inform decision-making and planning for the subject well, which may decrease risk and/or uncertainty related to the subject well. Such previously-drilled wells are often neighboring (e.g., geographically proximate) wells to the subject well, and the analysis of data therefrom may be referred to as offset well analysis.

Offset well analysis enables events (e.g., a non-productive time (NPT) event, a no drilling surprises (NDS) event, or the like), hazards, and/or other risks associated with the previously-drilled, offset well to be considered during the planning and drilling of the subject well. Currently, offset well analysis is implemented by humans (e.g., drilling engineers), and thus may be subject to human biases, subjectivity, and different levels of skills and/or experience. Accordingly, current offset well analysis may have a relatively lower accuracy of determining whether a certain offset well is a valid analog to the subject well being planned.

Also, because current offset well analysis is manually implemented, only a relatively limited subset of offset well data is considered. For example, a human may only consider offset wells that are geographically proximate, such as those located in the same field or basin, while discounting or completely ignoring information from wells outside the geographically proximate area.

SUMMARY

In an example of the present disclosure, a method is provided for planning a well. The method includes receiving, by a processor, a well profile for the subject well. The well profile includes a plurality of sets of attributes, each corresponding to one of a plurality of depths of the subject well. The method also includes categorizing, by the processor, each of the sets of attributes as being in a first zone or in a second zone to generate a pivoted well profile, where the pivoted well profile comprises a number of the sets of attributes in the first zone and a number of the sets of attributes in the second zone. The method further includes comparing, by the processor, the pivoted well profile of the subject well to a library of well profiles, where each well profile in the library comprises a number of sets of attributes in the first zone, and a number of sets of attributes in the second zone. The method also includes identifying, by the processor and based on the comparison, an analog well from the library, where a difference between the well profile of the analog well and the pivoted well profile of the subject well is less than a threshold; and providing an indication of the identified analog well.

In another example of the present disclosure, a system is provided that includes a processor and a memory coupled to the processor. The memory is configured to store executable instructions that, when executed by the processor, cause the processor to be configured to receive a well profile for the subject well, the well profile comprising a plurality of sets of attributes, each corresponding to one of a plurality of depths of the subject well; and categorize each of the sets of attributes as being in a first zone or in a second zone to generate a pivoted well profile, where the pivoted well profile comprises a number of the sets of attributes in the first zone and a number of the sets of attributes in the second zone. The processor is also configured to compare the pivoted well profile of the subject well to a library of well profiles, where each well profile in the library comprises a number of sets of attributes in the first zone, and a number of sets of attributes in the second zone; identify, based on the comparison, an analog well from the library, where a difference between the well profile of the analog well and the pivoted well profile of the subject well is less than a threshold; and provide an indication of the identified analog well.

In yet another example of the present disclosure, a non-transitory machine-readable medium contains instructions that, when executed by a processor, cause the processor to receive a well profile for the subject well, the well profile comprising a plurality of sets of attributes, each corresponding to one of a plurality of depths of the subject well; and categorize each of the sets of attributes as being in a first zone or in a second zone to generate a pivoted well profile, where the pivoted well profile comprises a number of the sets of attributes in the first zone and a number of the sets of attributes in the second zone. The processor is also configured to compare the pivoted well profile of the subject well to a library of well profiles, where each well profile in the library comprises a number of sets of attributes in the first zone, and a number of sets of attributes in the second zone; identify, based on the comparison, an analog well from the library, where a difference between the well profile of the analog well and the pivoted well profile of the subject well is less than a threshold; and provide an indication of the identified analog well.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
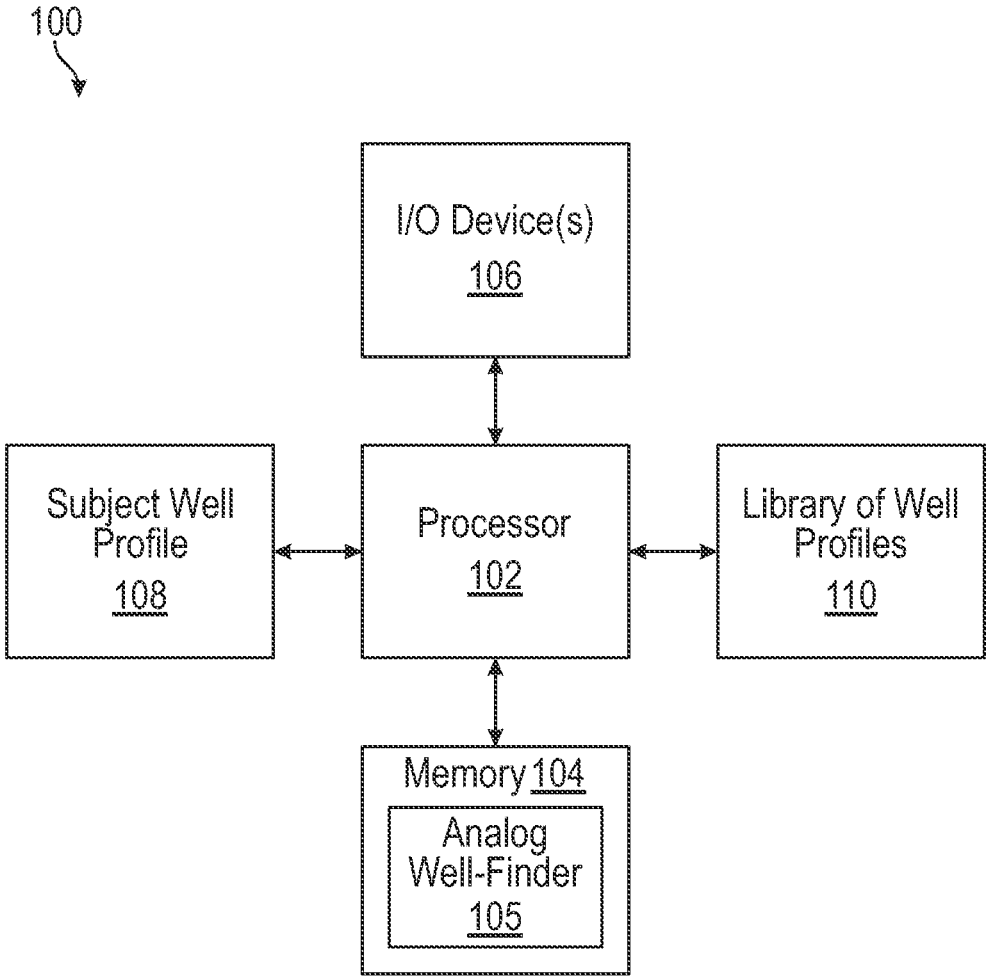
FIG. 1 is a block diagram of a system for planning a subject well by identifying analog wells in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

The systems and methods of identifying analog wells (such as implementing an analog well-finder tool) of this disclosure are generally described with reference to hydrocarbon wells. However, such an analog well-finder (and associated methods) may also be applied to geothermal energy extraction examples, as well as carbon-capture-utilization-storage (CCUS) well examples. The scope of the present disclosure is not intended to be limited to a particular type of well unless explicitly stated.

The present disclosure relates generally to planning a subject well by identifying analog well(s) with an analog well-finder tool and, more specifically, to automatically identifying analog well(s) based on a reduced set of attributes of the subject well, and subsequently adjusting one or more attributes of the subject well as part of planning drilling operations, completion operations, production operations, and the like for the subject well.

Offset well analysis is an important, although complex, part of the well planning process. As explained above, such planning process may encompass planning to drill the well, planning to complete the well, and planning to implement production operations for the well. Any of the foregoing processes or operations can potentially be improved by implementing a robust offset well analysis to identify accurate analog well(s) for the subject well being planned. In various examples, the accuracy of an analog well may refer to a measure of how numerically similar various attributes of the analog well are to those of the subject well.

Currently, human well planners attempt to mentally integrate large and complex data sources. These well planners also rely on manual data manipulation and/or personal experience to identify analog wells for the subject well being planned. Due to the time and effort needed for the well planner to perform such manual offset well analysis, it is common to restrict their analysis to focus only on offset wells that are geographically proximate to the subject well being planned, such as in the same field or basin.

Accordingly, it is difficult to properly and accurately identify analog well(s) for the subject well being planned. First, human well planners may lack access and/or ability to process large datasets of possible analog wells, and thus tend to restrict their analysis to geographically-proximate wells. Second, human well planners may possess biases and/or subjectivity in analyzing potential analog wells, which results in a less-accurate identification of analog wells, which in turn may result in a less-informed subject well planning process. Finally, even with the foregoing drawbacks of a manual offset well analysis implemented by a human well planner, such manual offset well analysis is cumbersome and time-consuming, which can delay the drilling of the subject well, further increasing costs to the operator. Thus, offset well analysis benefits from a more robust analysis of large amounts of data, without being limited to considering only potential analog wells that are geographically proximate to the subject well being planned, and where such analysis is performed in a more time-effective manner.

Embodiments disclosed herein address the foregoing by providing an analog well-finder (e.g., a software-implemented tool or module) that enables well planners to improve aspects of the well planning process at various times, which facilitates efficient, consistent, and improved well planning operations. As described further below, the analog well-finder includes computer-implemented functionality, such as a software program. The analog well-finder is not as affected by human biases and may analyze larger data sets than would be feasible when using a manual offset well analysis approach. Thus, the analog well-finder described herein enables faster, more accurate planning of a subject well. The analog well-finder may also increase or maintain safety levels during various aspects of the planning process for the subject well.

In various embodiments, the analog well-finder is configured to receive a well profile for the subject well being planned. The well profile may include a set of attributes corresponding to each of a plurality of depths for the subject well. For example, the well profile may include a first set of attributes corresponding to a first depth of the subject well, and a second set of attributes corresponding to a second depth of the subject well. The number of discrete depths of the subject well for which a corresponding set of attributes is provided may be relatively large. For example, the subject well may be on the order of 20,000 feet deep, and planned down to 1-foot intervals, which results in 20,000 discrete depths for which corresponding sets of attributes are planned.

These well attributes may include well trajectory attributes, hole section attributes, lithology attributes, equipment attributes, total depth drilled, total length drilled, information regarding faults crossed, and the like. Each of these attributes may also be a relatively broad category that encompasses multiple sub-attributes. For example, trajectory attributes may include a dogleg index attribute, a tortuosity attribute, and the like. As another example, equipment attributes may include a casing attribute (which may itself include various casing diameter attributes, various casing depth attributes, various casing length attributes, casing vendor attributes, and the like), a drill bit attribute, a bottomhole assembly (BHA) attribute, and the like. Accordingly, in addition to the well profile including sets of attributes for a large number of discrete depths, each set of attributes for the subject well may itself also include a large number of elements.

As described above, the well profile includes sets of attributes that span different depths of the subject well. For example, a first depth of the subject well is associated with a first set of values of the attributes, while a second depth of the subject well is associated with a second set of values of the attributes. In one, non-limiting example, which is introduced for simplicity and to assist in describing further examples below, a well is considered to be 20,000 feet deep, and attributes are planned (or measured, for previously-drilled wells) at 1-foot intervals. Accordingly, for a given well, regardless of whether it is the subject well being planned, or a previously-drilled well, the corresponding set of attributes includes a large number of attributes (e.g., variables) at each of 20,000 different data points, which may be unwieldly to process and/or otherwise glean useful information from. For example, for a given well, each data point, of which there are 20,000, there may be 50 different variables that can be used to describe the well. The embodiments described herein analyze such sets of attributes to identify analog well(s) for the subject well.

As described, the analog well-finder includes, or otherwise has access to, a library of well profiles from previously-drilled wells. In at least some embodiments, the library includes previously-drilled wells on a global scale; however, in other embodiments, the library includes at least some previously-drilled wells from geographic areas other than that in which the subject well is planned to be drilled. Accordingly, the library of well profiles enables the analog well-finder to consider a broader number of potential offset wells for the subject well than would be possible in a manual (i.e., human-implemented) offset well analysis.

In some examples, the analog well-finder is also configured to add the well profile for the subject well to the library of well profiles for previously-drilled wells. The analog well-finder may then reduce the well profile(s) (or the sets of attributes thereof) to sets of principal components, such as by applying principal component analysis (PCA) to the well profile(s). By reducing the sets of attributes to sets of principal components, attributes that are indicative of variation(s) or differences between sets are generally preserved, but with a reduction in dimensionality of the data set, rendering the resultant principal components more easily interpretable. The resulting principal components address (e.g., remove or reduce) highly cross-correlated variables making it more straightforward to cluster or otherwise manipulate those principal components, described further below.

Regardless of whether the sets of attributes in the well profile for the subject well—and the other well profiles in the library—are reduced, the analog well-finder is configured to categorize each of the sets of attributes (or reduced sets, if PCA is performed as described above) as being in a particular "zone" or "cluster". For the sake of clarity, as used herein, zone generally refers to a cluster or grouping of depths having similar characteristics, as described further below. In an embodiment, cluster analysis may be implemented on the well profile(s) to group or otherwise associate (e.g., cluster) those sets of attributes that display similar characteristics. For example, the cluster analysis may determine that the sets of attributes for each of the wells can be grouped into one of three zones: Zone 1, Zone 2, and Zone 3. Of course, in other examples, more or fewer zones may be determined, with a minimum of two zones (e.g., a first zone and a second zone). Continuing this particular example, the set of attributes for a first depth of the well may be associated with Zone 1, while the set of attributes for a second depth of the well may be associated with Zone 2, while the set of attributes for a third depth of the well may be associated with Zone 3. As described above, in one example there are 20,000 such depths, and performing cluster analysis categorizes each the depths into one of the three zones.

After the sets of attributes for various depths of the subject well have been categorized, the analog well-finder is configured to "pivot" the data to generate a pivoted well profile for the subject well that includes a number or quantity of depths having sets of attributes categorized with a particular zone. In some examples, the pivoted well profile may include a footage (e.g., a sum of depth values in feet) or other distance-based indication that is categorized in each of multiple zones. Continuing the example in which there are 20,000 depth data points, a pivoted well profile may indicate that 8,000 depth data points (or 8,000 feet) are categorized as Zone 1, that 7,000 depth data points (or 7,000 feet) are categorized as Zone 2, and that 5,000 depth data points (or 5,000 feet) are categorized as Zone 3. The well profiles of other wells in the library may be similarly pivoted, or may already be in a pivoted form.

The analog well-finder is configured to compare the pivoted well profile for the subject well to the library of well profiles. Accordingly, the analog well-finder is also configured to identify an analog well from the library based on the comparison. For example, the pivoted well profile, and the other well profiles in the library, may be represented as points in n-dimensional space, where n is equal to the number of zones (e.g., 3 in this example). Thus, the analog well(s) may be identified based on a difference or distance between their representative points in n-dimensional space being less than a threshold difference or distance. In some embodiments, the analog well-finder may identify more than one analog well. Regardless of the number of identified analog wells, the analog well-finder is configured to provide an indication of the identified analog well(s), such as on a user interface/display, which allows a well planner to more easily consider the analog well data to refine the subject well plan. In at least some examples, the identified analog well may be from a location that is geographically remote from the subject well location, and thus would likely not have been considered in a manual offset well analysis. Additionally, the analog well-finder may improve the accuracy of the determination of whether a particular well is an analog to the subject well.

In some embodiments, a user (e.g., a well planner) may adjust one or more attributes for the subject well based on the identified analog well, including an event thereof. For example, the event may be an NPT event or an NDS event, either of which is useful to avoid or at least reduce in severity. The adjustments may be based on learned experience of the user, or may be based on a recommendation provided by the analog well-finder. In another example, the analog well-finder is an automatic analog well-finder, and is thus configured to automatically adjust one or more of the attributes for the subject well, to improve or optimize planning of the subject well based on the identified analog well(s).

The analog well-finder is configured to generate an adjusted well profile by adjusting one or more of the sets of attributes for the subject well based on the event. Subsequently, the analog well-finder may re-run a search for analog wells using the adjusted well profile, in a manner similar to that described above. For example, the analog well-finder is configured to generate an adjusted, pivoted well profile by categorizing each of the adjusted sets of attributes for the subject well into a zone, as described above. The adjusted, pivoted well profile includes a number or quantity of depths having adjusted sets of attributes categorized with a particular zone. Then, the analog well-finder compares the adjusted, pivoted well profile to the library and either a) identifies a second analog well from the library, or b) confirms the previously-determined (i.e., first) analog well based on the comparison. In some examples, the analog well-finder identifies a different set of analog wells based on the adjusted, pivoted well profile of the subject well relative to the set of analog wells identified based on the first pivoted well profile of the subject well. Regardless of the particular identified analog wells, the analog well-finder is also configured to provide an indication of the identified analog well(s) as above. In this way, the analog well-finder can be used in an iterative fashion to improve or optimize planning of the subject well. These and other examples are described in further detail below, with reference made to the accompanying figures.

FIG. 1 is a block diagram of a system 100 for planning a subject well by identifying analog wells in accordance with the principles disclosed herein. The system 100 is a computer system 100 in some examples. The computer system 100 includes a processor 102 (which may be referred to as a central processor unit or CPU) that is in communication with one or more memory devices 104, and input/output (I/O) devices 106. The processor 102 may be implemented as one or more CPU chips. The memory devices 104 of computer system 100 may include secondary storage (e.g., one or more disk drives, etc.), a non-volatile memory device such as read only memory (ROM), and a volatile memory device such as random access memory (RAM). In some contexts, the secondary storage ROM, and/or RAM comprising the memory devices 104 of computer system 100 may be referred to as a non-transitory computer readable medium or a computer readable storage media. I/O devices 106 may include printers, video monitors, liquid crystal displays (LCDs), touch screen displays, keyboards, keypads, switches, dials, mice, and/or other well-known input devices.

It is understood that by programming and/or loading executable instructions onto the computer system 100, at least one of the CPU 102, the memory devices 104 are changed, transforming the computer system 100 in part into a particular machine or apparatus having the novel functionality taught by the present disclosure. Additionally, after the computer system 100 is turned on or booted, the CPU 102 may execute a computer program or application. For example, the CPU 102 may execute software or firmware stored in the memory devices 104. The software stored in the memory devices 104 and executed by CPU 102 may comprise the analog well-finder 105 described herein. During execution, an application may load instructions into the CPU 102, for example load some of the instructions of the application into a cache of the CPU 102. In some contexts, an application that is executed may be said to configure the CPU 102 to do something, e.g., to configure the CPU 102 to perform the function or functions promoted by the subject application. When the CPU 102 is configured in this way by the application, the CPU 102 becomes a specific purpose computer or a specific purpose machine.

Accordingly, the analog well-finder 105 is stored in the memory device 104 and is executed by the CPU 102 of the computer system 100, which may be a well-planning computer system 100 in some examples. As will be described further herein, the analog well-finder 105 is generally configured to provide an indication of identified analog well(s), such as on the I/O device(s) 106, which allows a well planner to more easily consider the analog well data to refine the subject well plan. In at least some examples, the identified analog well may be from a location that is geographically remote from the subject well location, and thus would likely not have been considered in a manual offset well analysis. Additionally, the analog well-finder 105 may improve the accuracy of the determination of whether a particular well is an analog to the subject well.

As described above, human well planners perform offset well analysis by attempting to mentally integrate large and complex data sources. These well planners also rely on manual data manipulation and/or personal experience to identify analog wells for the subject well being planned. Due to the time and effort needed for the well planner to perform such manual offset well analysis, it is common to restrict their analysis to focus only on offset wells that are geographically proximate to the subject well being planned, such as in the same field or basin.

Accordingly, it is difficult to properly and accurately identify analog well(s) for the subject well being planned. Thus, offset well analysis benefits from a more robust analysis of large amounts of data, without being limited to considering only potential analog wells that are geographically proximate to the subject well being planned, and where such analysis is performed in a more time-effective manner.

Figure 2:
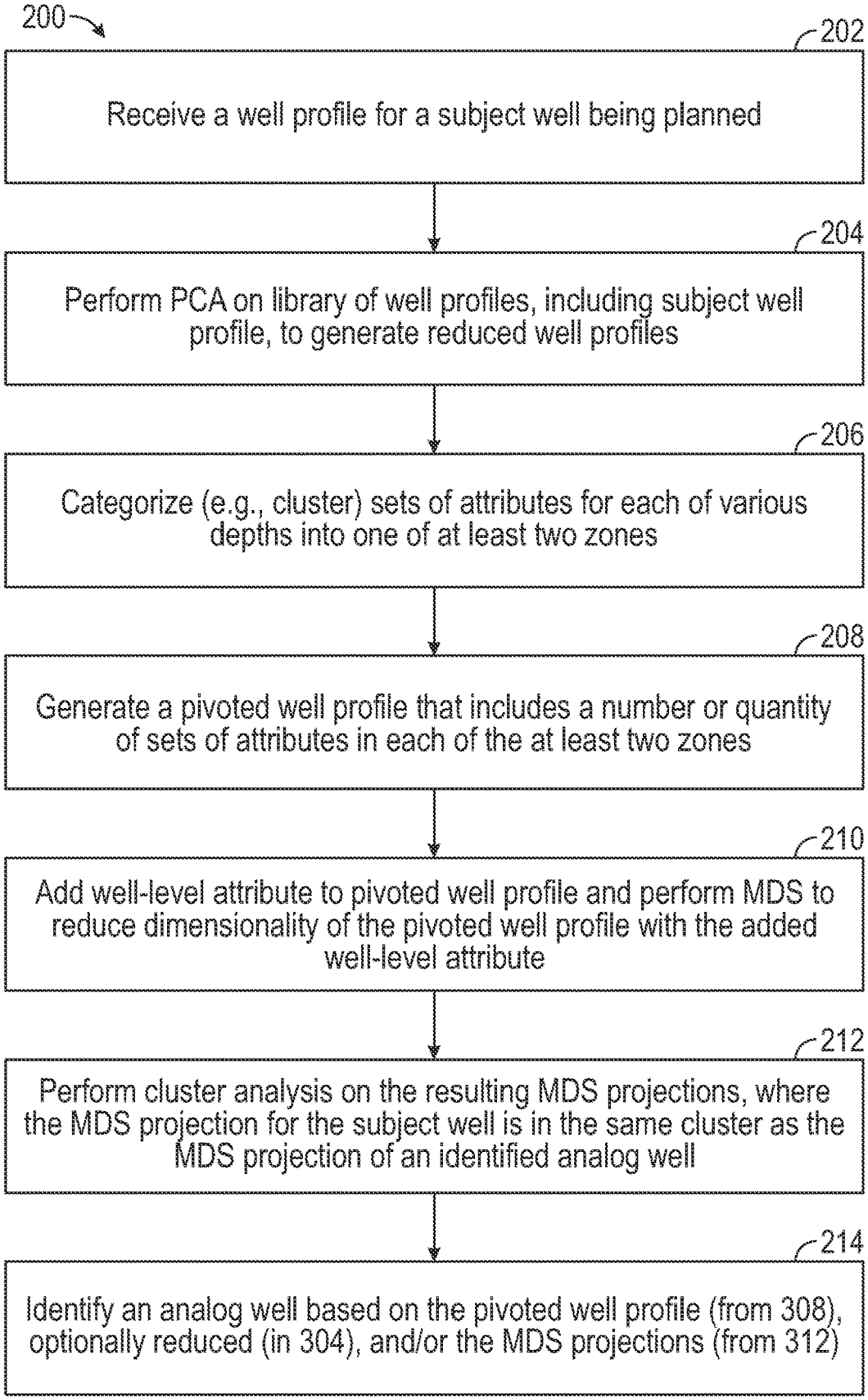
FIG. 2 is a flowchart of a method for planning a subject well by identifying analog wells in accordance with the principles disclosed herein.

The disclosed analog well-finder 105 addresses the foregoing drawbacks. FIG. 2 is a flowchart of a method 200 for planning a subject well by identifying analog wells in accordance with the principles disclosed herein. The method 200 may be implemented, at least in part, by the analog well-finder 105 (or by the processor 102 executing the analog well-finder 105). As described, the analog well-finder 105 enables well planners to improve aspects of the well planning process at various times, which facilitates efficient, consistent, and improved well planning operations. The analog well-finder 105 is not as affected by human biases and may analyze larger data sets than would be feasible when using a manual offset well analysis approach. Thus, the analog well-finder 105 enables faster, more accurate planning of a subject well. The analog well-finder 105 may also increase or maintain safety levels during various aspects of the planning process for the subject well.

The method 200 begins in block 202 with the analog well-finder 105 receiving a well profile for the subject well being planned. Referring back to FIG. 1, this is illustrated by the processor 102 receiving the subject well profile 108. The well profile may include a set of attributes corresponding to each of a plurality of depths for the subject well. For example, the well profile may include a first set of attributes corresponding to a first depth of the subject well, a second set of attributes corresponding to a second depth of the subject well, and so on. The following Table 1 illustrates an example well profile.

TABLE 1

| Example Well Profile | | | | |
|---|---|---|---|---|
| | Attribute 1 | Attribute 2 | . . . | Attribute n |
| Depth 1 | | {Set 1} | | |
| Depth 2 | | {Set 2} | | |
| . . . | | . . . | | |
| Depth n | | {Set n} | | |

In Table 1, a number of discrete depths 1, 2, . . . , n for the well are each associated with a corresponding set of attributes. Both the number of discrete depths, and the number of attributes in each set, may be relatively large. For example, the subject well may be on the order of 20,000 feet deep, and planned down to 1-foot intervals, which results in 20,000 discrete depths for which corresponding sets of attributes are planned. At the same time, for each depth (e.g., data point), there may be on the order of 50 or more different attributes, or variables, that can be used to describe the well. The analog well-finder 105 is configured to analyze such well profiles to identify analog well(s) for the subject well.

The well attributes may include well trajectory attributes, hole section attributes, lithology attributes, equipment attributes, total depth drilled, total length drilled, information regarding faults crossed, and the like. Each of these attributes may also be a relatively broad category that encompasses multiple sub-attributes. For example, trajectory attributes may include a dogleg index attribute, a tortuosity attribute, and the like. As another example, equipment attributes may include a casing attribute (which may itself include various casing diameter attributes, various casing depth attributes, various casing length attributes, casing vendor attributes, and the like), a drill bit attribute, a bottomhole assembly (BHA) attribute, and the like.

In addition to the subject well profile 108, the analog well-finder 105 is also configured to access a library of well profiles (e.g., shown as 110 in FIG. 1). The library 110 of well profiles is of previously-drilled wells. In at least some embodiments, the library 110 includes previously-drilled wells on a global scale; however, in other embodiments, the library 110 includes at least some previously-drilled wells from geographic areas other than that in which the subject well is planned to be drilled. Accordingly, the library 110 of well profiles enables the analog well-finder 105 to consider a broader number of potential offset wells for the subject well than would be possible in a manual (i.e., human-implemented) offset well analysis.

As described above, the well profile (e.g., shown in Table 1) includes sets of attributes that span different depths of the subject well. For example, a first depth of the subject well is associated with a first set of values of the attributes (e.g., {Set 1}), while a second depth of the subject well is associated with a second set of values of the attributes (e.g., {Set 2}). In one, non-limiting example, which is repeated here for simplicity and to assist in describing further examples below, a well is considered to be 20,000 feet deep, and attributes are planned (or measured, for previously-drilled wells) at 1-foot intervals. Accordingly, for a given well, regardless of whether it is the subject well being planned, or a previously-drilled well, the corresponding set of attributes includes a large number of attributes (e.g., variables) at each of 20,000 different depth data points, which may be unwieldly to process and/or otherwise glean useful information from.

In some examples, the method 200 continues to block 204 with performing principal component analysis (PCA) on the library of well profiles. In some embodiments, block 204 is considered optional. For example, if a number of attributes in the original well profile (e.g., Table 1) is sufficiently small, such as below a processing threshold, then further reducing the number of attributes with PCA may not be as useful.

However, in embodiments in which PCA is performed, the subject well profile is first added to the library of other, previously-drilled well profiles. Thus, the library 110 is updated to include the subject well profile as well. The analog well-finder 105 then reduces the well profile(s) in the library 110 to sets of principal components by applying PCA to the library 110. For example, prior to PCA, the well profiles may include a large number of attributes in each set, at each depth. By reducing the sets of attributes to sets of principal components, attributes that are indicative of variation(s) or differences between sets are generally preserved, but with a reduction in dimensionality of the data set, rendering the resultant principal components more easily interpretable, and more straightforward to cluster or otherwise manipulate, described further below.

Regardless of whether the sets of attributes in the well profile for the subject well—and the other well profiles in the library 110—are reduced, the method 200 continues in block 206 with the analog well-finder 105 categorizing each of the sets of attributes (or reduced sets, if PCA is performed in block 204) as being in a particular "zone" or "cluster". For example, the analog well-finder 105 may implement cluster analysis on the well profile(s) to group or otherwise associate (e.g., cluster) those sets of attributes that display similar characteristics. For example, the cluster analysis may determine that the sets of attributes for each of the wells can be grouped into one of three zones: Zone 1, Zone 2, and Zone 3. Of course, in other examples, more or fewer zones may be determined, with a minimum of two zones (e.g., a first zone and a second zone). Continuing this particular example, the set of attributes for a first depth of the well may be associated with Zone 1, while the set of attributes for a second depth of the well may be associated with Zone 2, while the set of attributes for a third depth of the well may be associated with Zone 3. As described above, in one example there are 20,000 such depths, and performing cluster analysis categorizes each the depths into one of the three zones. The following Table 2 illustrates an example well profile categorized by zone.

TABLE 2

| Example Well Profile Categorized by Zone | |
|---|---|
| Depth 1 | Zone__ |
| Depth 2 | Zone__ |
| Depth 3 | Zone__ |
| . . . | . . . |
| Depth n | Zone__ |

Figure 3:
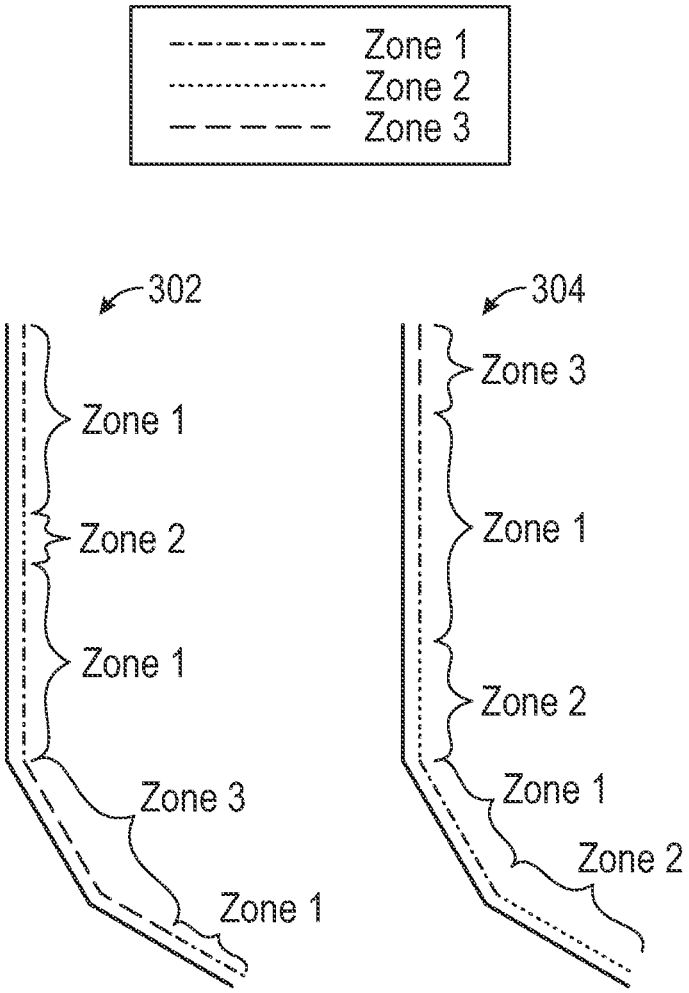
FIG. 3 is a schematic diagram of first and second wells categorized by zone in accordance with the principles disclosed herein.

In Table 2, each discrete depth 1, 2, . . . , n for the well is categorized into a particular zone (e.g., using cluster analysis). Referring briefly to FIG. 3, an example of a first well 302 and a second well 304 categorized by zone is shown. The wells 302, 304 are not shown to scale. However, it is apparent that the first well 302 includes a predominant number of depths categorized as Zone 1, and decreasing numbers of depths categorized as Zone 2, and then as Zone 3. Also, the second well 304 includes approximately equal numbers of depths categorized as each of Zone 1 and Zone 2, and a relatively fewer number of depths categorized as Zone 3. In the example of FIG. 3, and as described above, the depths in the first well 302 categorized as Zone 1 may have sufficiently similar (e.g., clustered) associated attributes (or principal components, if reduced using PCA in block 204). Similarly, the depths in the second well 304 categorized as Zone 1 may have sufficiently similar (e.g., clustered) associated attributes (or principal components, if reduced using PCA in block 204) with each other, and also with those depths in the first well 302 categorized as Zone 1. The foregoing applies similarly to the depths in each of the first well 302 and the second well 304 categorized as Zone 2, and to the depths in each of the first well 302 and the second well 304 categorized as Zone 3.

After the sets of attributes for various depths of the subject well have been categorized in block 206, the method 200 continues to block 208 with the analog well-finder 105 generating a pivoted well profile based on the example well profile categorized by zone, shown in FIG. 1 above. This may be referred to as "pivoting" the data from Table 2 to generate the pivoted well profile. The pivoted well profile includes a number or quantity of depths having sets of attributes categorized with a particular zone. The following Table 3 illustrates an example of a pivoted well profile.

TABLE 3

| Example Pivoted Well Profile | | | | |
|---|---|---|---|---|
| | Zone 1 | Zone 2 | . . . | Zone n |
| # of depths in zone | 8,000 | 7,000 | . . . | 5,000 |

Continuing the example in which there are 20,000 depth data points, the pivoted well profile may indicate that 8,000 depth data points are categorized as Zone 1, that 7,000 depth data points are categorized as Zone 2, and that 5,000 depth data points are categorized as Zone 3 (e.g., Zone n in Table 3). Referring again to FIG. 3, the example well profile of Table 3 may be for the first well 302, in which a sum of the depths categorized as Zone 1 is 8,000 feet, a sum of the depths categorized as Zone 2 is 7,000 feet, and a sum of the depths categorized as Zone 3 is 5,000 feet. The well profiles of other wells in the library 110 may be similarly pivoted, or may already be in a pivoted form.

In some examples, following the block 208, the method 200 continues with the analog well-finder 105 comparing the pivoted well profile for the subject well to the library 110 of well profiles, and proceeding to block 214 and identifying an analog well from the library 110 based on the comparison.

For example, the pivoted well profile, and the other well profiles in the library 110, may be represented as points in n-dimensional space, where n is equal to the number of zones (e.g., 3 in this example). The first well 302, being a subject well in this example, may be represented by the ordered triple (8,000; 7,000; 5,000).

Thus, the analog well(s) may be identified based on a difference or distance between their representative points in n-dimensional space being less than a threshold difference or distance from the ordered triple for the subject well 302. In some embodiments, the analog well-finder 105 may identify more than one analog well. Regardless of the number of identified analog wells, the analog well-finder 105 is configured to provide an indication of the identified analog well(s), such as on a user interface/display 106, which allows a well planner to more easily consider the analog well data to refine the subject well plan. In at least some examples, the identified analog well may be from a location that is geographically remote from the subject well 302 location, and thus would likely not have been considered in a manual offset well analysis. Additionally, the analog well-finder 105 may improve the accuracy of the determination of whether a particular well is an analog to the subject well 302.

In other examples, following the block 208, the method 200 continues to block 210 with the analog well-finder 105 adding one or more well-level attributes to the pivoted well profile (of both the subject well as well as the other well profiles in the library 110). As used herein, well-level attributes are attributes that do not vary as a function of depth of the well. For example, well-level attributes may include a location of the well (e.g., latitude and longitude, or an identification of a region or basin in which the well resides, or will reside); tortuosity indices for the well (e.g., three-dimensional indices, vertical indices, lateral indices); descriptive statistics (e.g., minimum, median, maximum, interquartile range (IQR)) for wellbore geometric information (e.g., azimuth, inclination, reach, horizontal departure, dogleg severity, build rate); geographical coordinates (e.g., surface and/or bottom hole); number of days old, which may be a proxy for technological developments available at the time the particular well was drilled; top/base mud depth and/or total vertical depth; or inclination at salt and/or slump entry and/or exit. The following Table 4 illustrates an example of a pivoted well profile with added well-level attribute(s).

TABLE 4

Example Pivoted Well Profile with Added Well-Level Attributes

| | Zone 1 | Zone 2 | . . . | Zone n | W-L Attribute 1 | W-L Attribute 2 | . . . | W-L Attribute n |
|---|---|---|---|---|---|---|---|---|
| # of sets in zone | 8,000 | 7,000 | . . . | 5,000 | | | | |

Similar to performing PCA above, adding well-level attributes to the pivoted well profile increases the dimensionality of the resulting vector, illustrated above in Table 4. Accordingly, it may be useful to reduce the resultant dimensionality, such as by performing multi-dimensional scaling (MDS) to generate a MDS projection based on the pivoted well profile with the added well-level attribute(s). MDS may be performed on the library 110 of well profiles (or reduced well profiles, if PCA was applied as in block 204), which generates MDS projections for each of the well profiles in the library 110, including the subject well. The MDS projections have a reduced dimensionality relative to the pivoted well profile with the added well-level attribute(s).

The method 200 then continues in block 212 with the analog well-finder 105 performing cluster analysis on the resulting MDS projections, and in block 214 with the analog well-finder 105 identifying the analog well based on the MDS projections. For example, the analog well may be identified as the well(s) associated with MDS projections in the same cluster as the MDS projection of the subject well.

In some embodiments, a user (e.g., a well planner) may adjust the well profile (e.g., one or more attributes thereof) for the subject well based on the identified analog well from block 214, including an event thereof. For example, the analog well may be associated with an event such as an NPT event or an NDS event, either of which is useful to avoid or at least reduce severity. The adjustments may be based on learned experience of the user, or may be based on a recommendation provided by the analog well-finder 105. In another example, the analog well-finder 105 is an automatic analog well-finder 105, and is thus configured to automatically adjust the well profile (e.g., one or more attributes thereof) for the subject well, to improve or optimize planning of the subject well based on the identified analog well(s) from block 214.

The method 200, or portions thereof, may then be repeated using the adjusted well profile for the subject well as the starting point in block 202. That is, the analog well-finder 105 re-runs a search for analog wells using the adjusted well profile, using the method 200 or portions thereof. In a subsequent iteration of the method 200 (e.g., using an adjusted well profile for the subject well), the analog well-finder 105 may either a) identify a second analog well from the library 110, or b) confirm the previously-determined (i.e., first) analog well based on the comparison. Regardless of the particular identified analog wells, the analog well-finder 105 is also configured to provide an indication of the identified analog well(s) as above. In this way, the analog well-finder 105 can be used in an iterative fashion to improve or optimize planning of the subject well. Following the improvement or optimization of the subject well plan, embodiments of this disclosure may include drilling the subject well according to the improved or optimized subject well plan (e.g., the adjusted well profile or attributes thereof).

Figure 4:
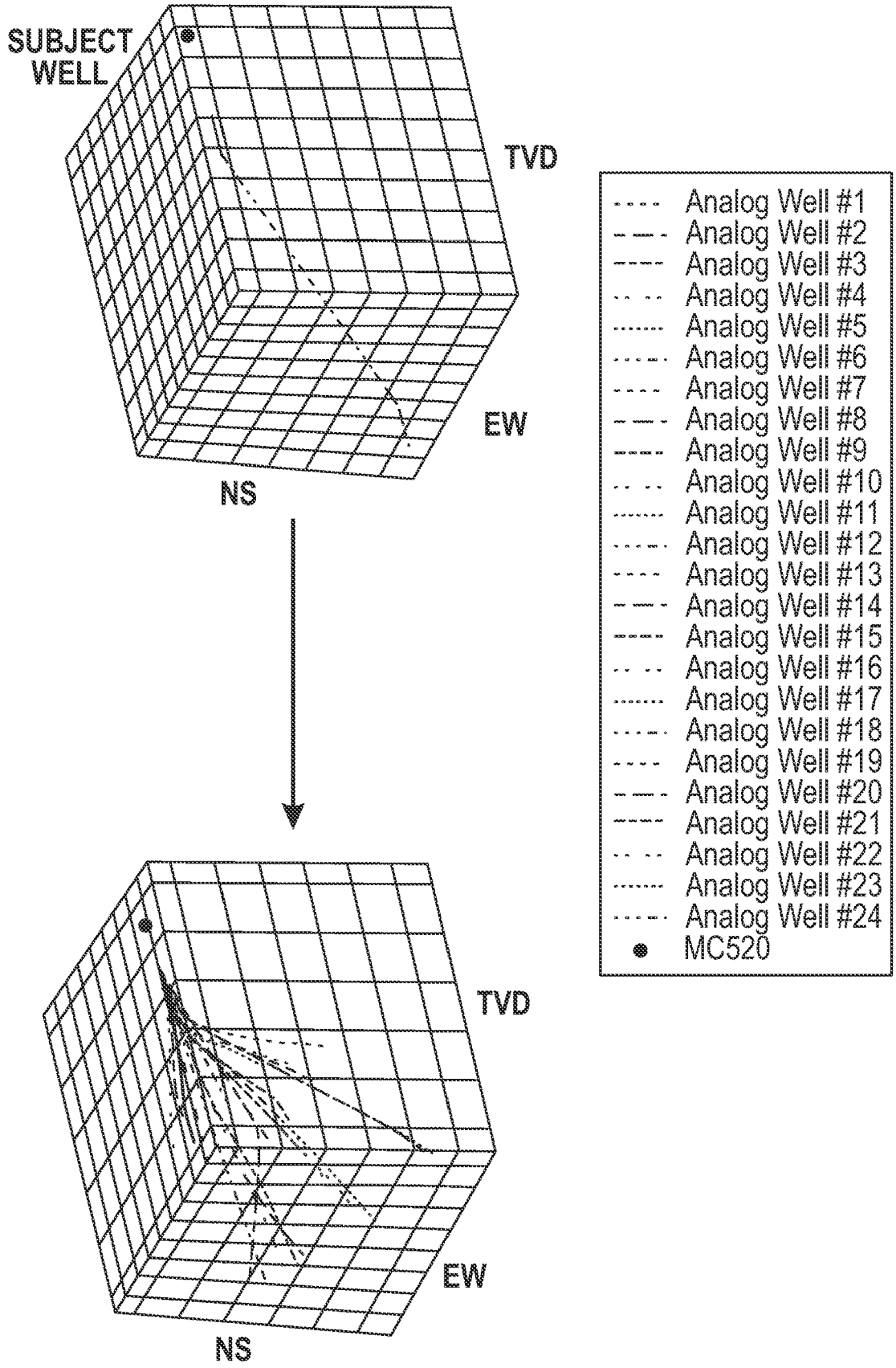
FIG. 4 is a schematic diagram of a planned subject well trajectory and trajectories of resulting analog wells identified in accordance with the principles disclosed herein.

FIG. 4 is a schematic diagram 400 of a planned subject well trajectory and trajectories of resulting analog wells identified using the analog well-finder 105 as described above, and in accordance with the principles disclosed herein. The trajectories in the diagram 400 are shown as a function of latitude (e.g., NS), longitude (e.g., EW), and total vertical depth (TVD). As demonstrated in FIG. 4, the method 200 implemented by the analog well-finder 105 results in a set of analog wells that are largely similar to the planned subject well. In at least some examples, the identified analog wells may be from geographic areas other than that in which the subject well is planned to be drilled. Such geographically-remote analog wells would not have been considered by a human user. Accordingly, the analog well-finder 105 is enabled to consider a broader number of potential offset wells for the subject well than would be possible in a manual (i.e., human-implemented) offset well analysis.

Figure 5:
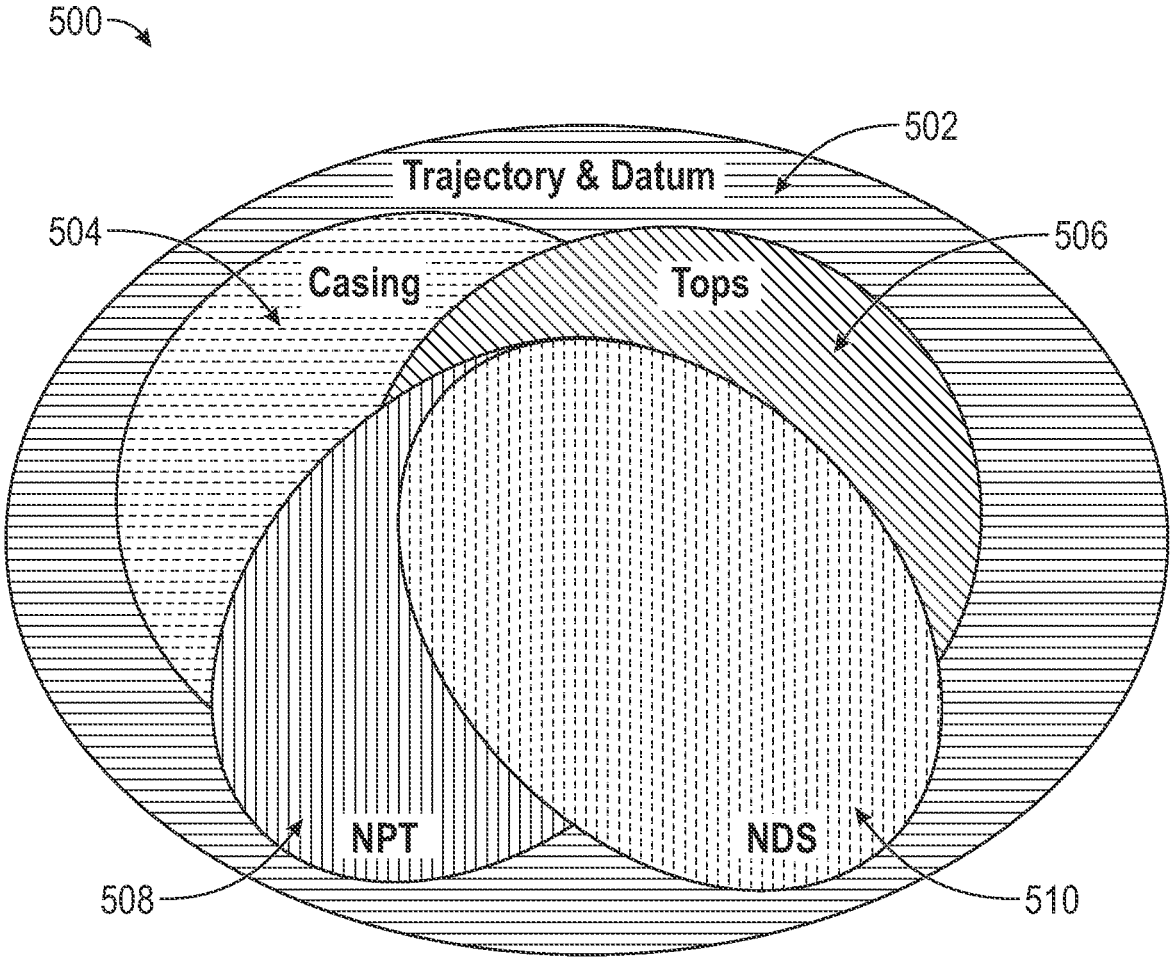
FIG. 5 is a schematic diagram of available attributes for wells in a library of profile wells in accordance with the principles disclosed herein.

FIG. 5 is a schematic diagram 500 of available attributes for wells in a library of profile wells in accordance with the principles disclosed herein. For example, a set 502 includes all the wells in the library 110 for which trajectory and datum are available. A subset 504 of the set 502 includes the wells in the library 110 for which casing data is available. A subset 506 of the set 502 includes the wells in the library 110 for which tops data is available. A subset 508 of the set 502 includes the wells in the library 110 for which NPT event data is available. Finally, a subset 510 of the set 502 includes the wells in the library 110 for which NDS event data is available. Overlapping portions of the subsets 504, 506, 508, and/or 510 indicate further subsets where multiple data types (of the overlapping subsets) are available.

In some embodiments, the analog well-finder 105 is configured to receive a filter input for the well profile of the subject well. For example, the filter input may specify an attribute of interest in the well profile of the subject well, and may indicate that a user of the analog well-finder wishes to restrict results (e.g., analog wells) to only those for which the particular data/attribute identified by the filter input are available. Accordingly, prior to comparing the pivoted well profile of the subject well to the library 110 of well profiles, the analog well-finder 105 is configured to restrict the library 110 to only those well profiles that correspond to the filter input (e.g., only those well profiles for which the particular data/attribute identified by the filter input are available). The subsequent comparison of the pivoted well profile of the subject well is to the restricted library 110 that results, rather than the full library 110, and thus the identified analog well(s) will contain the attribute of interest to the user.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for planning a subject well, the method comprising:

receiving, by a processor, a well profile for the subject well, the well profile comprising a plurality of sets of attributes, each set of attributes corresponding to one of a plurality of depths of the subject well;

categorizing, by the processor, each set of attributes of the plurality of sets of attributes as being in a first zone or in a second zone to generate a pivoted well profile, wherein the pivoted well profile comprises:

a number of sets of attributes in the first zone; and a number of sets of attributes in the second zone;

comparing, by the processor, the pivoted well profile of the subject well to a library of well profiles, wherein each well profile in the library comprises:

a number of sets of attributes in the first zone; and a number of sets of attributes in the second zone;

adding, by the processor, the well profile for the subject well to the library of well profiles;

performing, by the processor, principal component analysis on the library including the well profile for the subject well to generate reduced well profiles for the subject well and for the well profiles in the library, wherein a reduced well profile for each well comprises a plurality of reduced sets of attributes, each reduced set of attributes corresponding to one of a plurality of depths of the well, wherein categorizing each set of attributes of the plurality of sets of attributes comprises categorizing the plurality of reduced sets of attributes as being in the first zone or in the second zone to generate a reduced, pivoted well profile that comprises a number of reduced sets of attributes in the first zone and a number of reduced sets of attributes in the second zone, and wherein comparing the pivoted well profile comprises comparing the reduced, pivoted well profile of the subject well to the reduced well profiles in the library, identifying, by the processor and based on the comparison, an analog well from the library, wherein a difference between a reduced well profile of the identified analog well and the reduced, pivoted well profile of the subject well is less than a threshold; and providing an indication of the identified analog well.

2. The method of claim 1, further comprising:

adding, by the processor, one or more well-level attributes to the reduced, pivoted well profile of the subject well and to the reduced well profiles in the library, wherein a well-level attribute does not vary as a function of depth of the well;

performing, by the processor, multi-dimensional scaling (MDS) on the library of reduced well profiles, including the reduced, pivoted well profile of the subject well, and including the one or more well-level attributes, to generate an MDS projection for each well in the library including the subject well; and performing, by the processor, cluster analysis on the MDS projection for each well in the library including the subject well, wherein an MDS projection of the identified analog well is in a same cluster as an MDS projection for the subject well.

3. The method of claim 1, further comprising generating, by the processor, an adjusted well profile for the subject well by adjusting one or more of the plurality of sets of attributes for the subject well based on an event of the identified analog well.

4. The method of claim 3, wherein the identified analog well is a first analog well, the method further comprising:

categorizing, by the processor, each of the adjusted one or more of the plurality of sets of attributes for the subject well as being in the first zone or in the second zone to generate an adjusted, pivoted well profile, wherein the adjusted, pivoted well profile comprises:

a number of adjusted sets of attributes in the first zone; and a number of adjusted sets of attributes in the second zone;

comparing, by the processor, the adjusted, pivoted well profile of the subject well to the library of well profiles;

either a) identifying, by the processor and based on the comparison of the adjusted, pivoted well profile, a second analog well from the library, wherein a difference between a well profile of the second analog well and the adjusted, pivoted well profile of the subject well is less than the threshold; or b) confirming, by the processor, the first analog well from the library based on the comparison of the adjusted, pivoted well profile; and providing, by the processor, an indication of the identified second analog well or the confirmed first analog well.

5. The method of claim 3, further comprising automatically generating, by the processor, the adjusted well profile by automatically adjusting the one or more of the plurality of sets of attributes for the subject well by the processor, wherein the adjustment is based on the event of the identified analog well.

6. The method of claim 3, wherein the event comprises a non-productive time (NPT) event, a no drilling surprises (NDS) event, or combinations thereof.

7. The method of claim 3, further comprising drilling the subject well according to the adjusted one or more of the plurality of sets of attributes.

8. The method of claim 1, further comprising:

receiving, by the processor, a filter input for the well profile for the subject well;

prior to comparing the pivoted well profile of the subject well to the library of well profiles, restricting, by the processor, the library of well profiles to only the well profiles that correspond to the filter input; and comparing, by the processor, the pivoted well profile of the subject well to the restricted library of well profiles to identify the analog well.

9. The method of claim 1, wherein the plurality of sets of attributes for the subject well comprise trajectory attitudes, hole section, lithology, equipment to be used, total depth drilled, total length drilled, faults crossed by the subject well, or combinations thereof.

10. The method of claim 1, wherein the subject well is planned for a first location, wherein the identified analog well is from a second location, and wherein the first location is geographically remote from the second location.

11. A system for planning a subject well, the system comprising:

a processor; and a memory coupled to the processor, wherein the memory is configured to store executable instructions that, when executed by the processor, cause the processor to be configured to:

receive a well profile for the subject well, the well profile comprising a plurality of sets of attributes, each set of attributes corresponding to one of a plurality of depths of the subject well;

categorize each set of attributes of the plurality of sets of attributes as being in a first zone or in a second zone to generate a pivoted well profile, wherein the pivoted well profile comprises:

a number of sets of attributes in the first zone; and a number of sets of attributes in the second zone;

compare the pivoted well profile of the subject well to a library of well profiles, wherein each well profile in the library comprises:

a number of sets of attributes in the first zone; and a number of sets of attributes in the second zone;

add the well profile for the subject well to the library of well profiles;

perform principal component analysis on the library including the well profile for the subject well to generate reduced well profiles for the subject well and for the well profiles in the library, wherein a reduced well profile for each well comprises a plurality of reduced sets of attributes, each reduced set of attributes corresponding to one of a plurality of depths of the well, wherein categorizing each set of attributes of the plurality of sets of attributes comprises categorizing the plurality of reduced sets of attributes as being in the first zone or in the second zone to generate a reduced, pivoted well profile that comprises a number of reduced sets of attributes in the first zone and a number of reduced sets of attributes in the second zone, and wherein comparing the pivoted well profile comprises comparing the reduced, pivoted well profile of the subject well to the reduced well profiles in the library;

identify, based on the comparison, an analog well from the library, wherein a difference between a reduced well profile of the identified analog well and the reduced, pivoted well profile of the subject well is less than a threshold; and provide an indication of the identified analog well.

12. The system of claim 11, wherein the executable instructions, when executed by the processor, further cause the processor to be configured to:

add one or more well-level attributes to the reduced, pivoted well profile of the subject well and to the reduced well profiles in the library, wherein a well-level attribute does not vary as a function of depth of the well;

perform multi-dimensional scaling (MDS) on the library of reduced well profiles, including the reduced, pivoted well profile of the subject well, and including the one or more added well-level attributes, to generate an MDS projection for each well in the library including the subject well; and perform cluster analysis on the MDS projection for each well in the library including the subject well, wherein an MDS projection of the identified analog well is in a same cluster as an MDS projection for the subject well.

13. The system of claim 11, further comprising a display coupled to the processor, wherein the processor is configured to provide the indication of the identified analog well on the display.

14. The system of claim 11, wherein the executable instructions, when executed by the processor, further cause the processor to be configured to generate an adjusted well profile for the subject well by adjusting one or more of the plurality of sets of attributes for the subject well based on an event of the identified analog well.

15. The system of claim 14, wherein the identified analog well is a first analog well, and wherein the executable instructions, when executed by the processor, further cause the processor to be configured to:

categorize each of the adjusted one or more of the plurality of sets of attributes for the subject well as being in the first zone or in the second zone to generate an adjusted, pivoted well profile, wherein the adjusted, pivoted well profile comprises:

a number of adjusted sets of attributes in the first zone; and a number of adjusted sets of attributes in the second zone;

compare the adjusted, pivoted well profile of the subject well to the library of well profiles;

either a) identify, based on the comparison of the adjusted, pivoted well profile, a second analog well from the library, wherein a difference between a well profile of the second analog well and the adjusted, pivoted well profile of the subject well is less than the threshold; or b) confirm the first analog well from the library based on the comparison of the adjusted, pivoted well profile; and provide an indication of the identified second analog well or the confirmed first analog well.

16. The system of claim 11, wherein the executable instructions, when executed by the processor, further cause the processor to be configured to:

receive a filter input for the well profile for the subject well;

prior to comparing the pivoted well profile of the subject well to the library of well profiles, restrict the library of well profiles to only the well profiles that correspond to the filter input; and compare the pivoted well profile of the subject well to the restricted library of well profiles.

17. The system of claim 11, wherein the subject well is planned for a first location, wherein the identified analog well is from a second location, and wherein the first location is geographically remote from the second location.

18. A non-transitory computer-readable medium including instructions that, when executed by a processor, cause the processor to;

receive a well profile for a subject well" in order to provide appropriate antecedence basis, the well profile comprising a plurality of sets of attributes, each set of attributes corresponding to one of a plurality of depths of the subject well;

categorize each set of attributes of the plurality of sets of attributes as being in a first zone or in a second zone to generate a pivoted well profile, wherein the pivoted well profile comprises:

a number of sets of attributes in the first zone; and a number of sets of attributes in the second zone;

compare the pivoted well profile of the subject well to a library of well profiles, wherein each well profile in the library comprises:

a number of sets of attributes in the first zone; and a number of sets of attributes in the second zone;

add the well profile for the subject well to the library of well profiles;

perform principal component analysis on the library including the well profile for the subject well to generate reduced well profiles for the subject well and for the well profiles in the library, wherein a reduced well profile for each well comprises a plurality of reduced sets of attributes, each reduced set of attributes corresponding to one of a plurality of depths of the well wherein categorizing each set of attributes of the plurality of sets of attributes comprises categorizing the plurality of reduced sets of attributes as being in the first zone or in the second zone to generate a reduced, pivoted well profile that comprises a number of reduced sets of attributes in the first zone and a number of reduced sets of attributes in the second zone and wherein comparing the pivoted well profile comprises comparing the reduced, pivoted well profile of the subject well to the reduced well profiles in the library;

identify, based on the comparison, an analog well from the library, wherein a difference between a reduced well profile of the identified analog well and the reduced, pivoted well profile of the subject well is less than a threshold; and provide an indication of the identified analog well.

* * * * *